US011656043B2

(12) United States Patent
Mueller et al.

(10) Patent No.: US 11,656,043 B2
(45) Date of Patent: May 23, 2023

(54) WEAPON SYSTEM

(71) Applicant: RHEINMETALL WAFFE MUNITION GMBH, Suedheide (DE)

(72) Inventors: Michael Mueller, Geislingen (DE); Klaus-Peter Eggert, Zimmern (DE)

(73) Assignee: Rheinmetall Waffe Munition GmbH, Suedheide (DE)

( * ) Notice: Subject to any disclaimer, the term of this patent is extended or adjusted under 35 U.S.C. 154(b) by 0 days.

(21) Appl. No.: 17/582,684

(22) Filed: Jan. 24, 2022

(65) Prior Publication Data

US 2022/0146220 A1 May 12, 2022

Related U.S. Application Data

(63) Continuation of application No. PCT/EP2020/069273, filed on Jul. 8, 2020.

(30) Foreign Application Priority Data

Jul. 25, 2019 (DE) ..... 10 2019 120 179.9

(51) Int. Cl.
*F41A 5/08* (2006.01)
*F41A 3/46* (2006.01)
(Continued)

(52) U.S. Cl.
CPC ..... *F41A 5/08* (2013.01); *F41A 3/46* (2013.01); *F41A 5/32* (2013.01); *F41A 15/14* (2013.01)

(58) Field of Classification Search
CPC ..... F41A 3/26; F41A 3/46; F41A 5/08; F41A 5/32; F41A 7/08; F41A 15/14
(Continued)

(56) References Cited

U.S. PATENT DOCUMENTS 4,227,439 A * 10/1980 Gillum ..... F41A 3/70 89/190
4,553,469 A * 11/1985 Atchisson ..... F41A 35/02 42/25
(Continued)

FOREIGN PATENT DOCUMENTS

DE 139766 C 3/1903
DE 409091 C 2/1925
(Continued)

OTHER PUBLICATIONS

EPO, Written Opinion for PCT/EP2020/069273, dated 2020, Internet publication, pp. 1-5. (Year: 2020).*
(Continued)

*Primary Examiner* — Bret Hayes
(74) *Attorney, Agent, or Firm* — Muncy, Geissler, Olds & Lowe , P.C.

(57) ABSTRACT

A weapon system that includes a breechblock, which is formed at least by a breechblock carrier and a breechblock head, the breechblock carrier being designed so as to carry the breechblock head. To achieve the fact that forces acting upon the breechblock drive during the unlocking of the breechblock and the withdrawal of a cartridge casing are minimized or even eliminated, the breechblock head is freely movable relative to the breechblock carrier. To separate the breechblock with a breechblock drive of the weapon system during the recoil of the recoiling masses of the weapon system, a device is designed in such a way that a mechanical separation takes place between the breechblock and the breechblock drive during the recoil of the recoiling masses of the weapon system. During the forward motion of the recoiling masses, the mechanical connection between the breechblock drive and the breechblock is reestablished via the device.

14 Claims, 7 Drawing Sheets

(51) Int. Cl.
*F41A 5/32* (2006.01)
*F41A 15/14* (2006.01)

(58) Field of Classification Search
USPC ..... 89/180–183, 187.01–190
See application file for complete search history.

(56) References Cited

U.S. PATENT DOCUMENTS

| | | | | |
|---|---|---|---|---|
| 4,700,608 | A * | 10/1987 | Pettinga | F41A 7/08 89/1.4 |
| 8,402,874 | B2 | 3/2013 | Herrmann et al. | |
| 8,616,112 | B2 | 12/2013 | Herrmann et al. | |
| 8,677,883 | B2 | 3/2014 | Woessner et al. | |
| 10,401,109 | B2 | 9/2019 | Mueller et al. | |
| 10,488,135 | B2 | 11/2019 | Mueller et al. | |
| 10,591,241 | B2 | 3/2020 | Schneider | |
| 10,739,102 | B2 | 8/2020 | Schneider | |
| 2018/0066904 | A1* | 3/2018 | Tuason | F41A 3/46 |
| 2018/0224227 | A1* | 8/2018 | Durham, III | F41A 3/26 |

FOREIGN PATENT DOCUMENTS

| | | | | |
|---|---|---|---|---|
| DE | 3712905 | A1 | 11/1988 | |
| DE | 102006022622 | A1 | 11/2007 | |
| DE | 102008060215 | A1 | 6/2010 | |
| DE | 102008060217 | A1 | 6/2010 | |
| DE | 102009011939 | B4 | 9/2010 | |
| DE | 102009058551 | B4 | 9/2011 | |
| DE | 102010009427 | B4 | 9/2011 | |
| DE | 102015121771 | A1 | 1/2017 | |
| DE | 102015121770 | A1 | 6/2017 | |
| EP | 2018509 | B1 | 1/2009 | |
| GB | 194722 | A * | 11/1923 | F41A 3/36 |

OTHER PUBLICATIONS

International Search Report dated Oct. 23, 2020 in corresponding application PCT/EP2020/069273.

* cited by examiner

WEAPON SYSTEM

This nonprovisional application is a continuation of International Application No. PCT/EP2020/069273, which was filed on Jul. 8, 2020, and which claims priority to German Patent Application No. 10 2019 120 179.9, which was filed in Germany on Jul. 25, 2019, and which are both herein incorporated by reference.

BACKGROUND OF THE INVENTION

Field of the Invention

The present invention relates to a possibility, in particular for unlocking a breechblock of a weapon system, for example an externally driven autocannon. The invention deals, in particular, with a forward unlocking of a breechblock upon a forward motion of recoiling masses subsequent to a recoil of these recoiling masses.

Description of the Background Art

Self-driven or externally driven weapon systems are known, such as, in particular autocannons. In weapon systems of this type, a cartridge is placed in front of a breechblock, and the cartridge is introduced into a gun barrel or into a chamber of the gun barrel with the aid of a breechblock drive. The breechblock movement includes standstill times, in which the breechblock may not be moved. The locking between the breechblock and the gun barrel takes place using known breechblock systems, such as a block lock, falling block, rotary bolt lock, etc.

A rotary bolt lock and a weapon including a rotary bolt lock are known from DE 10 2010 009 427 B4, which corresponds to U.S. Pat. No. 8,677,883. The rotary bolt lock includes a breechblock carrier and a breechblock head supported therein, which includes multiple locking lugs. The rotary bolt lock is designed in such a way that the unlocking action, in which the cartridge casing is released from a chamber of the gun barrel, is not controlled exclusively via the relative movement between the breechblock head and the breechblock carrier. For this purpose, a control curve section is formed in the locking piece, which interacts with a correspondingly formed control section in the breechblock head. During the unlocking, the rotational movement of the breechblock head is converted into a screwing movement relative to the locking piece. This screwing movement guides the breechblock head out of the locking head in a screwing manner. The same control curves and control curve sections also handle the locking of the breechblock.

DE 10 2009 058 551 B4 discloses a further rotating bolt. A rotating bolt cylinder is held in the unlocked position on the breechblock carrier by a tongue-in-groove-like toothing of a slot. A guide tray of the breechblock carrier may be reduced thereby to the extent that it secures the rotating bolt cylinder only against tilting out of the functional axis.

A breechblock system for an externally drivable and/or self-drivable weapon is apparent from DE 10 2009 011 939 B4, which includes a block lock. Upon the recoil of the recoiling mass of the weapon, the block lock is driven out via control curves on the breechblock carrier for the purpose of unlocking, and driven back in for the purpose of locking upon the recoil of the weapon.

A locking of the breechblock or the breechblock head with the barrel is generally established in such a way that the locking itself takes place by a central tube, which is connected in practice to the barrel and possibly to a recoil damper, etc.

A functional control is known from EP 2 018 509 B1, in particular for the linear guidance of an ammunition into a gun barrel. The externally driven weapon, or the externally driven weapon system, comprises a locking ring, including lugs, which is situated on the gun barrel such that it extends thereover, as well as lugs on a breechblock head. If the breechblock head is present at the gun barrel. the protruding locking ring is rotated, whereby the lugs of the locking ring is moved behind the lugs of the breechblock head, and the breechblock is locked. The rotation of the locking ring takes place by a bolt guided in a control curve. The unlocking takes place by reversing the movement of the bolt in the control curve. The standstill times needed for the weapon are implemented here via the interacting control slot and the drive slot.

A machine gun having firing control is known from DE 37 12 905 A1. The breechblock is made up of a breechblock upper part and a carriage, which are each arranged such that they may be displaced longitudinally and separately in the weapon casing and may be coupled with each other in a form-fitting manner using connecting means. If a cartridge malfunctions, the decoupled breechblock upper part remains in the locking position, while all other weapon functions or movements are not braked but continue to move. A gas pressure-controlled decoupling of the breechblock upper part from the carriage is provided.

Such, in particular externally driven, systems, in particular chain drives, have the problem that great forces act upon the chain during the unlocking of the breechblock and the removal of the empty cartridge casing, it being necessary for the chain to apply the removal forces.

SUMMARY OF THE INVENTION

It is therefore an object of the present invention to solve this problem.

In an exemplary embodiment, the invention is based on the idea of minimizing the forces acting upon the breechblock drive when the breechblock is unlocked and the cartridge casing removed. The forces acting upon the breechblock drive when the breechblock is unlocked and the cartridge casing removed are thus to be reduced or even eliminated, in particular, in the case of an external drive, e.g. chain.

These functions of the breechblock drive are transferred, according to the invention, to the breechblock and the gun barrel, the breechblock and gun barrel handling the unlocking of the breechblock and removal of a cartridge casing independently of the breechblock drive.

In implementing the idea, the recoil of the weapon after the firing is used for unlocking the breechblock from the gun barrel and removing the cartridge casing, i.e., the unlocking and removal of the cartridge casing are implemented using the recoil, and thus the recoiling masses of a weapon. A recoil is known to take place upon the release of a shot, whereby the recoiling masses of a weapon, such as the gun barrel and breechblock, are accelerated against the firing direction. At the end of the recoil, a portion of the recoil energy is stored in recuperator springs of a recoil mechanism or the like. The recoiling masses are moved forward again by this energy and are in forward motion.

During the period of the weapon recoil, a mechanical separation and a mechanical connection of the breechblock drive and the breechblock from each other or to each other are provided. According to the invention, the breechblock is now mechanically separated from the breechblock drive during the recoil of the recoiling masses for the purpose of unlocking the breechblock and removing the cartridge casing. At the end of the forward motion of the recoiling masses, the mechanical separation produced during the recoil is discontinued, the functionality is restored, the breechblock drive and the breechblock are again mechanically coupled with each other.

With this basic idea, a new approach is provided for avoiding deficiencies and problems, in particular of an external drive. The fact is also taken into account that, in an externally driven weapon, the breechblock is at the point in time of the shot release, i.e. in the locked state, while the external drive continues to operate. See for example DE 10 2015 121 771 A1 (which corresponds to US 2018/0231344, which is incorporated herein by reference) and DE 10 2008 060 217 A1 (which corresponds to US2012/0132062, which is incorporated herein by reference).

In continuation of this idea, the actual unlocking of the breechblock as well as the removal of the cartridge casing are then carried out during the forward motion of the recoiling mass subsequent to the recoil. The unlocking of the breechblock as well as the removal of the cartridge casing take place during the forward movement of the recoiling masses.

The breechblock according to the invention preferably comprises a breechblock carrier and a breechblock head carried thereby. The breechblock carrier may be held and transported by a breechblock slider. In this preferred constellation, the breechblock drive is mechanically connected to the breechblock carrier for the weapon function via the breechblock slider.

The mechanical separation between the breechblock slider and the breechblock carrier then takes place upon the recoil of the recoiling masses. At this point in time, the breechblock carrier may move relative to the breechblock slider. The mechanical connection between the breechblock carrier and the breechblock slider is reestablished upon the return and during the subsequent forward motion.

During the recoil, the breechblock head recoils together with the gun barrel as part of the recoiling masses. The separation of the breechblock carrier and the breechblock drive takes place during this recoil. The breechblock head is freely movable relative to the breechblock carrier during the recoil.

During the forward motion of the recoiling masses, the breechblock head is rotated in such a way that the connection between the breechblock head and the gun barrel is released, and the breechblock is unlocked. The breechblock head is also caught by the breechblock carrier. Due to the unlocking, the gun barrel, including the central tube, may continue to move forward without the breechblock head, so that the now stationary breechblock head may pull the cartridge casing out of the gun barrel with its removal claw, at least to some degree.

These functions or sequences are implemented by a correspondingly designed device. This device uses existing assemblies of the breechblock system in a special way. The device interacts with a breechblock carrier adapted for this purpose.

The device includes at least one first movable slide pointing in the direction of the gun barrel on the breechblock carrier. In the simplest variant, the latter may be inserted into the breechblock carrier. When the gun barrel, together with the breechblock head, reaches this slide, the latter takes a path in the breechblock carrier. At least one second slide is driven out. This further slide is rigidly connected to the breechblock slider and locks the breechblock carrier and the breechblock slider against each other. This locking or mechanical connection between the breechblock carrier and the breechblock slider is released by driving out the at least one second slide. The mechanical connection of the breechblock carrier to the breechblock drive, for example an external drive, is interrupted by this separation. At the same time, the breechblock carrier may now move freely to a limited extent.

During the forward motion of the recoiling masses, this at least one slide is then driven back in, and the mechanical connection between the breechblock carrier and the breechblock slider is reestablished. The breechblock carrier is again rigid in the breechblock system.

In continuation of the invention, when the breechblock carrier is reconnected to the breechblock slider, an at least third slide prevents the breechblock carrier from returning to its starting position (original position), i.e. all the way to the front, at this point in time. This forward movement of the breechblock carrier is blocked. During the recoil of the recoiling masses, this at least one third slide is passed over and is therefore without effect during the recoil itself.

During the further forward motion of the breechblock head and gun barrel, the breechblock head is then rotated along or within a guide or groove in the breechblock carrier. The breechblock head is unlocked from the central tube by this rotation. The gun barrel continues to move forward without the breechblock head held in the breechblock carrier, so that the gun barrel moves away from the (unlocked) breechblock head. The withdrawal process of the cartridge casing begins with the removal of the gun barrel. The breechblock head pulls the cartridge casing out of the gun barrel. The cartridge casing is released and already partially withdrawn when the gun barrel is in the neutral position.

The breechblock or breechblock head, including the breechblock carrier, which is again fixedly connected to the breechblock drive via the breechblock sider, may then be guided into its rear position within the scope of the actual weapon operation. The withdrawn cartridge casing is ejected in the known manner, and a new cartridge is placed in front of the breechblock.

During the actual weapon operation, upon the recoil of the breechblock, the breechblock carrier then takes its starting position via the breechblock drive in the direction of the firing position. The at least one third slide is then driven out by a first cam in such a way that a blocking released. The breechblock carrier itself may be subsequently returned or pressed into its starting position by springs.

The advantage of this idea is that the breechblock drive, in particular the external drive, no longer must apply the force for withdrawing the cartridge casing from the gun barrel. Associated therewith, a smaller drive, e.g. a smaller motor, etc., may now be used. The weapon may also be provided with a more compact design.

If the recoil fails to occur due to a misfiring, the device does not further intervene in the actual weapon function.

In continuation of the invention, a firing pin in the breechblock head is tensioned only upon the locking of the breechblock. If the breechblock is locked, a firing pin spring tensioned during the locking operation is relieved, and the firing pin is released. The relief of the firing pin spring may take place mechanically as well as electrically, e.g. magnetically. Due to the fact that the firing pin spring action takes place only upon the locking of the breechblock or the breechblock head, an undesirable release of the firing pin is ruled out during the transport of the weapon. An approach of this type is found, for example, in DE 10 2015 121 770 A1, which corresponds to US 2018/0292158, which is incorporated herein by reference.

A weapon system is thus proposed, which includes a breechblock, the breechblock being mechanically connected to a breechblock drive of the weapon system for the weapon operation. A device is designed for this purpose in such a way that a mechanical separation between the breechblock and the breechblock drive takes place upon a weapon recoil, i.e. the recoil of the recoiling masses of the weapon system. During the forward motion of the recoiling masses, a mechanical connection between the breechblock carrier and the breechblock is reestablished via the device.

The breechblock is formed by at least one breechblock carrier and a breechblock head, the breechblock carrier being designed to carry the breechblock head. To achieve the fact that forces acting upon the breechblock drive during the unlocking of the breechblock and the withdrawal of a cartridge casing are minimized or even eliminated, the breechblock head is freely movable relative to the breechblock carrier.

To separate the breechblock with a breechblock drive of the weapon system during the recoil of the recoiling masses of the weapon system, a device is designed in such a way that a mechanical separation takes place between the breechblock and the breechblock drive during the recoil of the recoiling masses of the weapon system. During the forward motion of the recoiling masses, the mechanical connection between the breechblock drive and the breechblock is reestablished via the device.

The device includes at least one connection rod for separating or connecting the breechblock from/to a breechblock slider, which functionally interacts with the breechblock carrier. The connection rod is fixedly mounted on the breechblock slider by a rear end, viewed in the firing direction. The front end may be connected to and separated from the breechblock carrier.

The present idea may also be used in testing. In particular, it may be used to ascertain the cartridge behavior, specifically the behavior of the withdrawal forces. For this purpose, the function of a test unit may be transferred to the present construction. Each shot maybe measured, i.e., the data may be known after each shot. For this purpose, measuring points may be provided on the at least one connection rod, e.g. with the aid of strain gauges. A test unit of this type is therefore also viewed as a weapon system.

The invention is not limited to an external drive as the breechblock drive.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
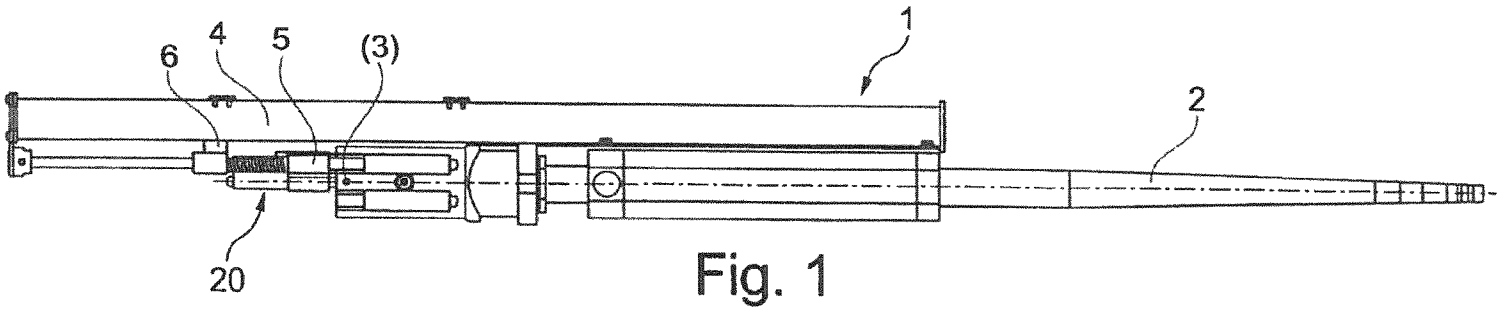
FIG. 1 shows a representation of the gun barrel, including a device according to the invention, in a side view.

A barrel assembly of a weapon is shown in FIG. 1 with reference numeral 1. This barrel assembly 1 comprises at least one gun barrel 2 as well as a breechblock head 3. Gun barrel 2 and breechblock head 3 are guided via a carrier 4 or are fastened thereto. Breechblock head 3 is carried by a breechblock carrier 5. Breechblock head 3 and breechblock carrier 5 form a breechblock. In the present preferred embodiment, breechblock carrier 5 is functionally connected to a breechblock slider 6 and the latter to a drive, an external drive in this case.

A motor is provided as the external drive, which moves a chain or a connecting rod to move the breechblock carrier 5, and thus the breechblock, from a front position (firing position) into a rear position (loading position). The necessary standstill times of the breechblock within the weapon are implemented via the external drive.

Reference numeral 20 designates a device/mechanical separator. The function of device 20 is a mechanical separation between breechblock carrier 5 and breechblock slider 6 when breechblock head 3 is still locked and is moved together with recoiling gun barrel 2 as part of the recoiling masses of the weapon system or the weapon against the firing direction. During the forward movement of the recoiling masses, device 20 discontinues this mechanical separation.

Figure 2:
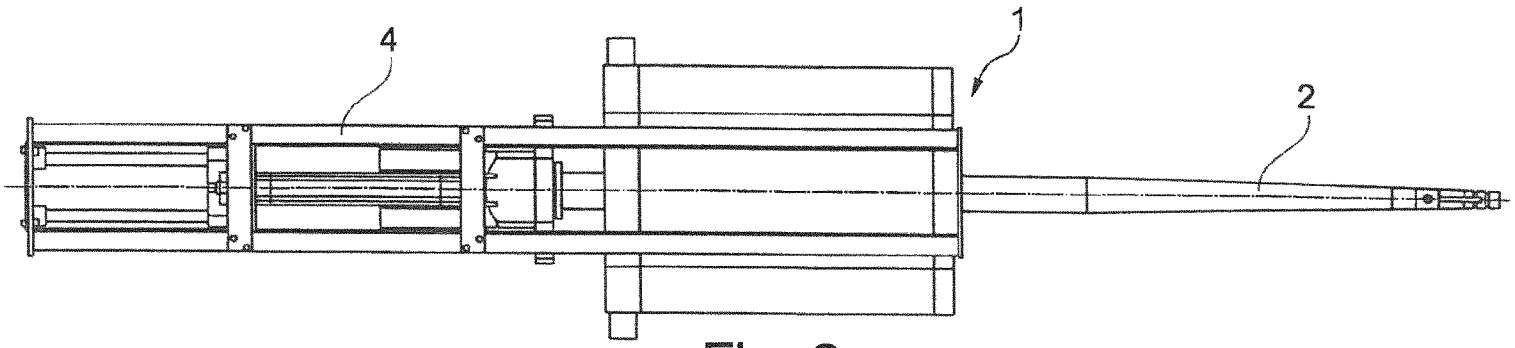
FIG. 2 shows a representation from FIG. 1 in a top view.
Figure 3:
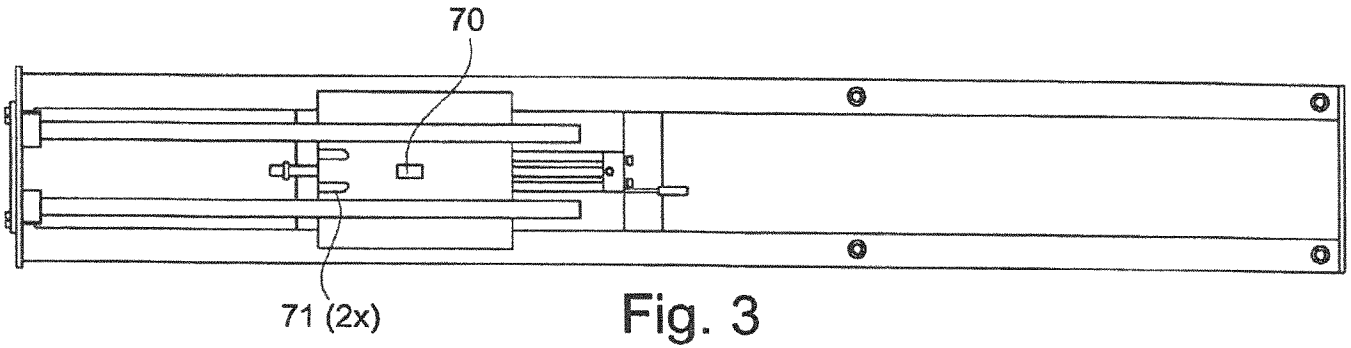
FIG. 3 shows the carrier or the carrier system from FIG. 1 in a view from below.

FIG. 2 shows barrel assembly 1 from FIG. 1 in a top view, and FIG. 3 shows a view of carrier system 4 from below.

Figure 4:
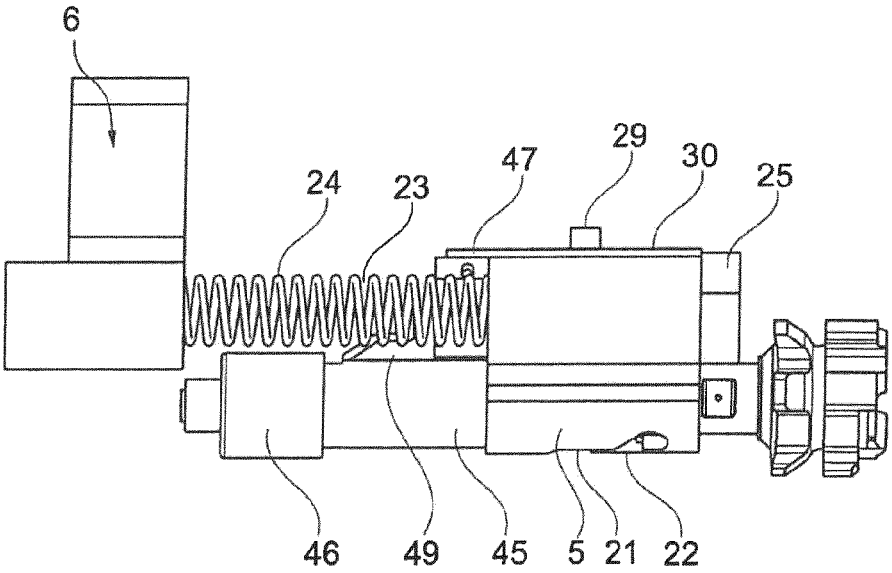
FIG. 4 shows a device illustrated in FIG. 1 in a side view.

An enlarged representation of device 20 is apparent in FIG. 4. Device 20 is apparent in cooperation with breechblock carrier 5 and in the operation of breechblock head 3. A guide groove or a guide curve 21 for a control bolt 22 of breechblock head 3 is introduced, preferably on the side, in breechblock carrier 5.

Figure 6:
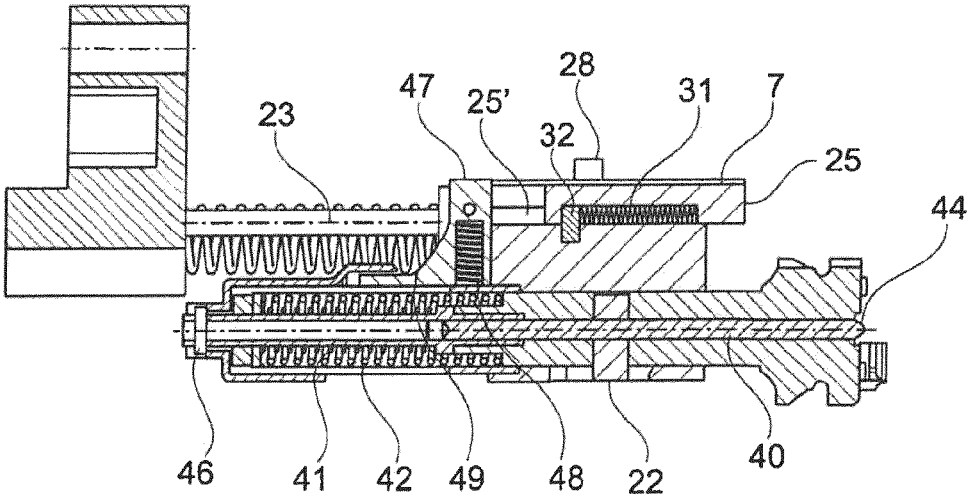
FIG. 6 shows the device from FIG. 4 in a sectional representation.

Breechblock carrier 5 is detachably connected to breechblock slider 6 via at least one connection rod 23 (FIG. 6). Connection rod 23 is fixedly mounted on breechblock slider 6 by a rear end, viewed in the firing direction. The front end is connected to breechblock carrier 5 and may be separated therefrom.

Connection rod 23 ensures that breechblock carrier 5 is fixedly connected to breechblock slider 6 for transporting the breechblock during the actual weapon operation. In addition to connection rod 23, a pressure spring 24, preferably a helical pressure spring in this case, is integrated or arranged between breechblock slider 6 and breechblock carrier 5.

Device 20 furthermore includes at least one first slide 25. This first slide 25 protrudes from breechblock carrier 5, pointing in the direction of gun barrel 2 (FIG. 4). As long as first slide 25 is not actuated, i.e. not pressed, breechblock carrier 5 and breechblock slider 6 form a mechanical unit via connection rod 23.

In addition to first slide 25, device 20 comprises at least one second slide 26. The latter is used to mechanically separate connection rod 23 from breechblock carrier 5 and may be driven out by first slide 25, so that connection rod 23 may release the connection with breechblock carrier 5 on the front end (FIG. 4).

FIG. 4 also shows guide curve 21 introduced into breechblock carrier 5, which is provided for guiding control bolt 22 of breechblock head 3 for unlocking breechblock head 3 from gun barrel 2. In addition, at least one spring sleeve 45 as well as a tensioning sleeve 46, which is displaceably and rotatably supported thereon, are also carried by breechblock carrier 5. Pressure springs 41, 42, preferably helical pressure springs, and a tensioning pin 43 for a firing pin 40 situated in a bore 44 in breechblock head 3, are introduced thereinto. Pressure spring 41 is used for tensioning firing pin 40. The function of pressure spring 42 is to transfer breechblock head 3 into an opened position and to hold it in its unlocked position.

These are illustrated in a sectional representation in FIG. 6. Reference numeral 31 marks a pressure spring of first slide 25. and reference numeral 32 marks its stop piece for first slide 25 in breechblock carrier 5.

Figure 8:
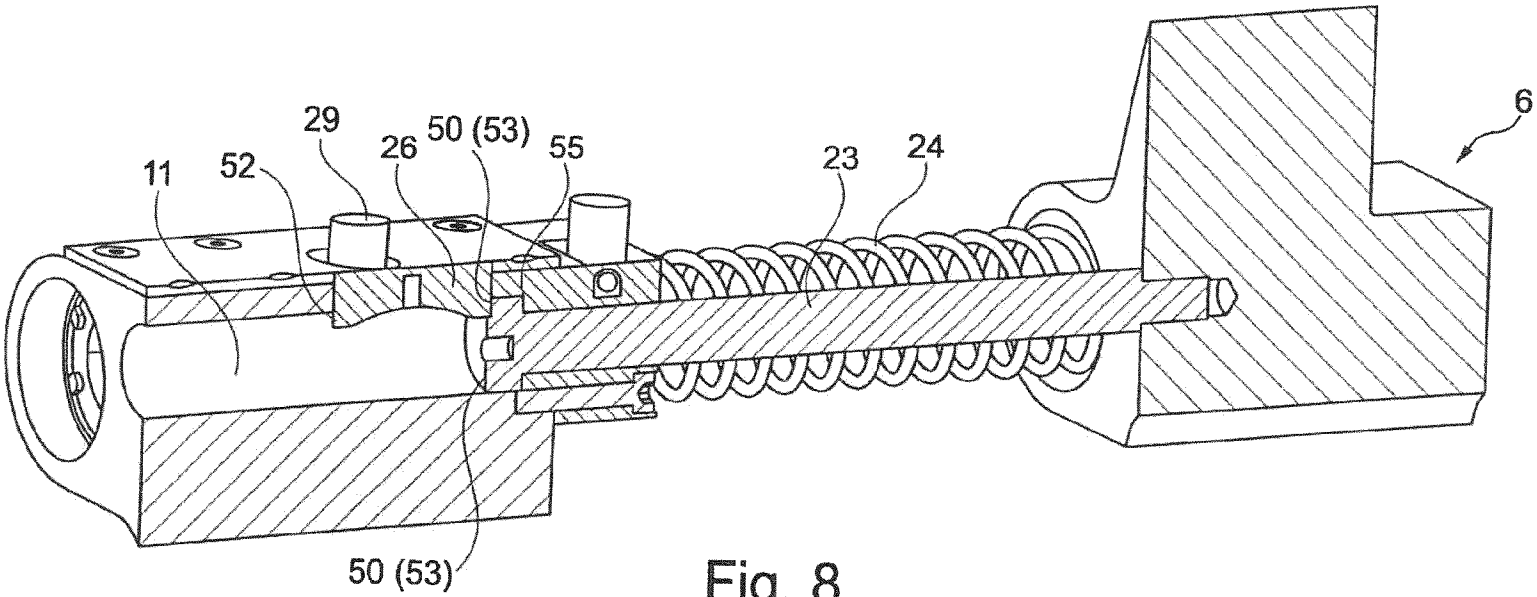
FIG. 8 shows a representation of a further section of the breechblock carrier from FIG. 7.

An exemplary operation is as follows:

According to the figures, the breechblock or breechblock head 3 is locked and the weapon discharged. The firing has taken place. Gun barrel 2, including the central tube, breechblock head 3 as well as assemblies 40, 46 integrated into/on breechblock head 3 as recoiling masses of the weapon, move toward the rear against the firing direction. Gun barrel 2 strikes first slide 25 and moves it along its path 25' within breechblock carrier 5. This first slide 25 pushes aside at least one second slide 26, due to the shape or contour of first slide 25. A blocking mechanism 50 provided by this second slide 26 and illustrated in FIG. 8 is released, the front end of connection rod 23 lying free within a bore 11 of breechblock carrier 5. The mechanical connection between breechblock carrier 5 and breechblock slider 6 is released. Breechblock carrier 5 is carried along by recoiling masses, while connection rod 23 may slide freely forward within bore 11. Connection rod 23 passes over at least one third slide 29 and pushes it away during the recoil of the recoiling masses.

At the end of the recoil, the recoiling masses are moved forward again together with breechblock carrier 5 in the firing direction, and the forward motion is ended. It is understood that this end of the recoil, or the path of the recoiling masses associated therewith, is taken into account in the length of bore 11.

With the forward motion of breechblock carrier 5, connection rod 23 is caught at a front edge 52 of the at least one third slide 29. The mechanical connection to breechblock slider 6 is reestablished thereby.

Due to the mechanical coupling of breechblock carrier 5 with breechblock slider 6, only breechblock head 3, together with locked gun barrel 2, now moves forward. Control bolt 22 on breechblock head 3 is guided along guide curve 21, and breechblock head 3 is rotated. The rotation of breechblock head 3 effectuates an unlocking of breechblock head 3 from gun barrel 2, which detaches from breechblock head 3 during the further forward motion and moves away from breechblock head 3. A cartridge casing, which is held by a withdrawal claw 54 of breechblock head 3 is pulled out, at least to some degree, from gun barrel 2 during this forward motion of gun barrel 2. The cartridge casing is released from gun barrel 2 at the point in time of the neutral position of gun barrel 2.

Breechblock carrier 5 takes up the starting position during its return transport by breechblock slider 6, i.e. upon the actual breechblock transport during the weapon operation. The at least one third slide 29 is driven out by a cam 71 on carrier 4, and the blocking mechanism is released by front edge 52 of slide 29. The front end of connection rod 23 slides under and past the at least one second slide 26 and moves back into its starting position. The front end of connection rod 23 comes to rest behind a rear edge 53 of the at least one second slide 26, which is placed in front of the front end of connection rod 23, driven by a pressure spring 27. The front end of connection rod 23 is secured toward the rear by an edge 55 in breechblock carrier 5 (FIG. 8).

Pressure spring 24 supports breechblock carrier 5 upon removal from its starting position. Breechblock slider 6 may continue to transport breechblock carrier 5 into its rear position within the weapon. The cartridge casing is ejected in this way.

Figure 5:
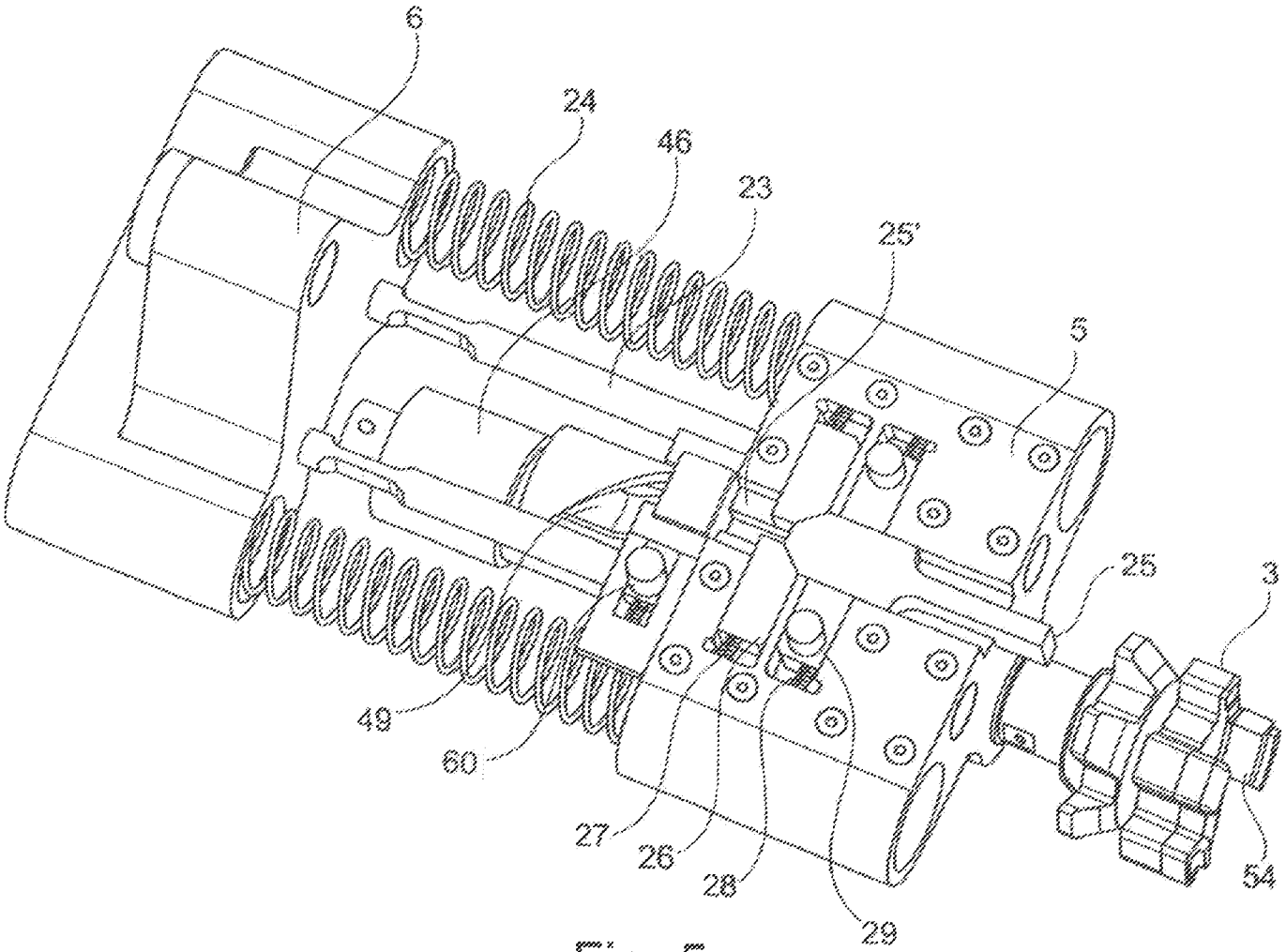
FIG. 5 shows the device from FIG. 4 in a representation without a cover, viewed from above.
Figure 7:
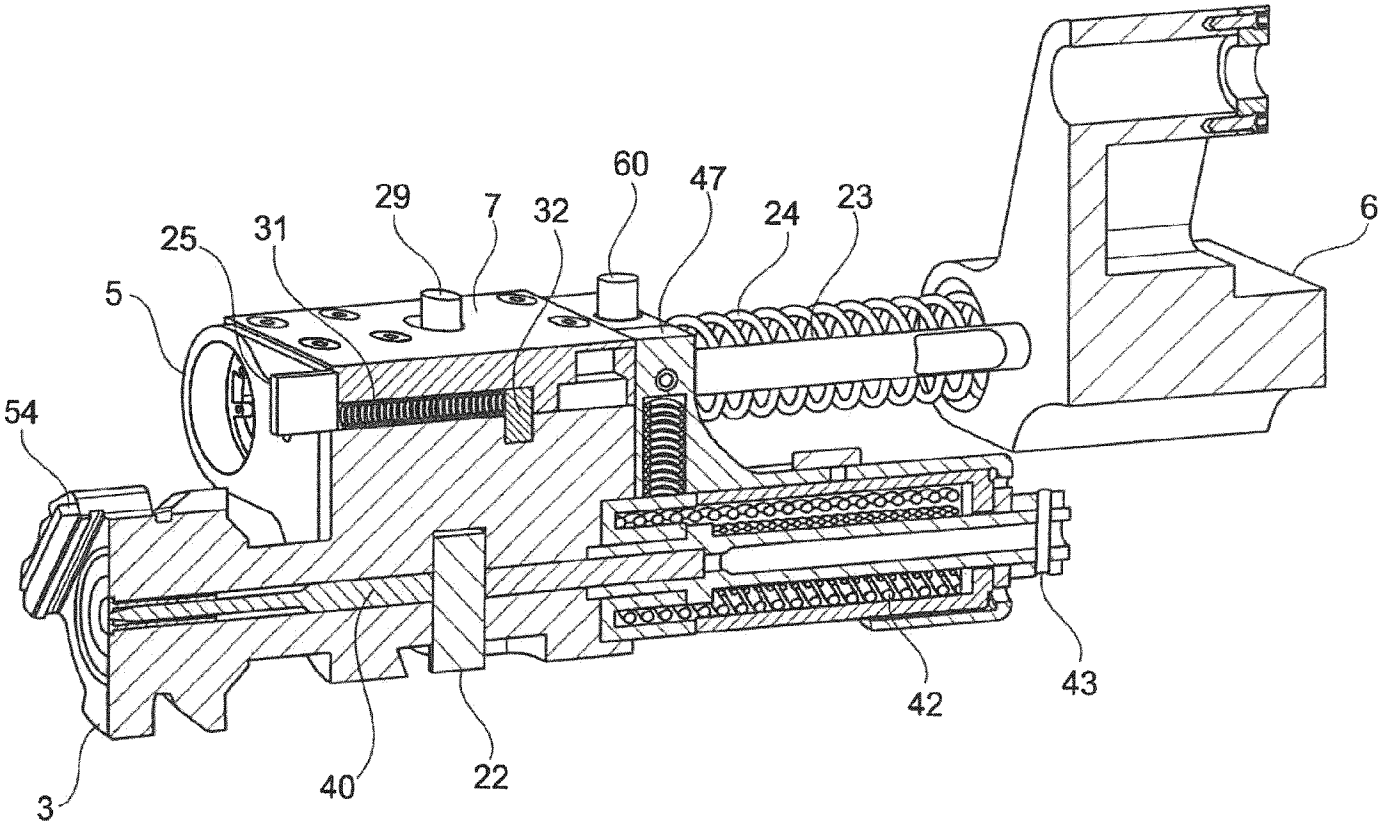
FIG. 7 shows a sectional representation of the breechblock carrier according to FIG. 1.

Two connection rods 23 are preferably used. They are oriented in parallel to each other, breechblock head 3 being arranged between the two. This construction increases the functional reliability of device 20. If two connection rods 23 are used, two pressure springs 24 as well as two second slides 26 are also provided within device 20 on breechblock carrier 5. They both interact functionally with particular connection rod 23. Slides 26 are supported in their function by pressure springs 27, preferably helical pressure springs. This structural design then preferably also necessitates two third slides 29 (FIG. 5) and two cams 71 on carrier 4.

The tensioning of firing pin 40 takes place during the locking of breechblock head 3 with gun barrel 2. For this purpose, breechblock carrier 5, together with breechblock head 3, is moved forward by breechblock slide 6, and the latter by a breechblock drive, again in the direction of gun barrel 2.

Figure 9:
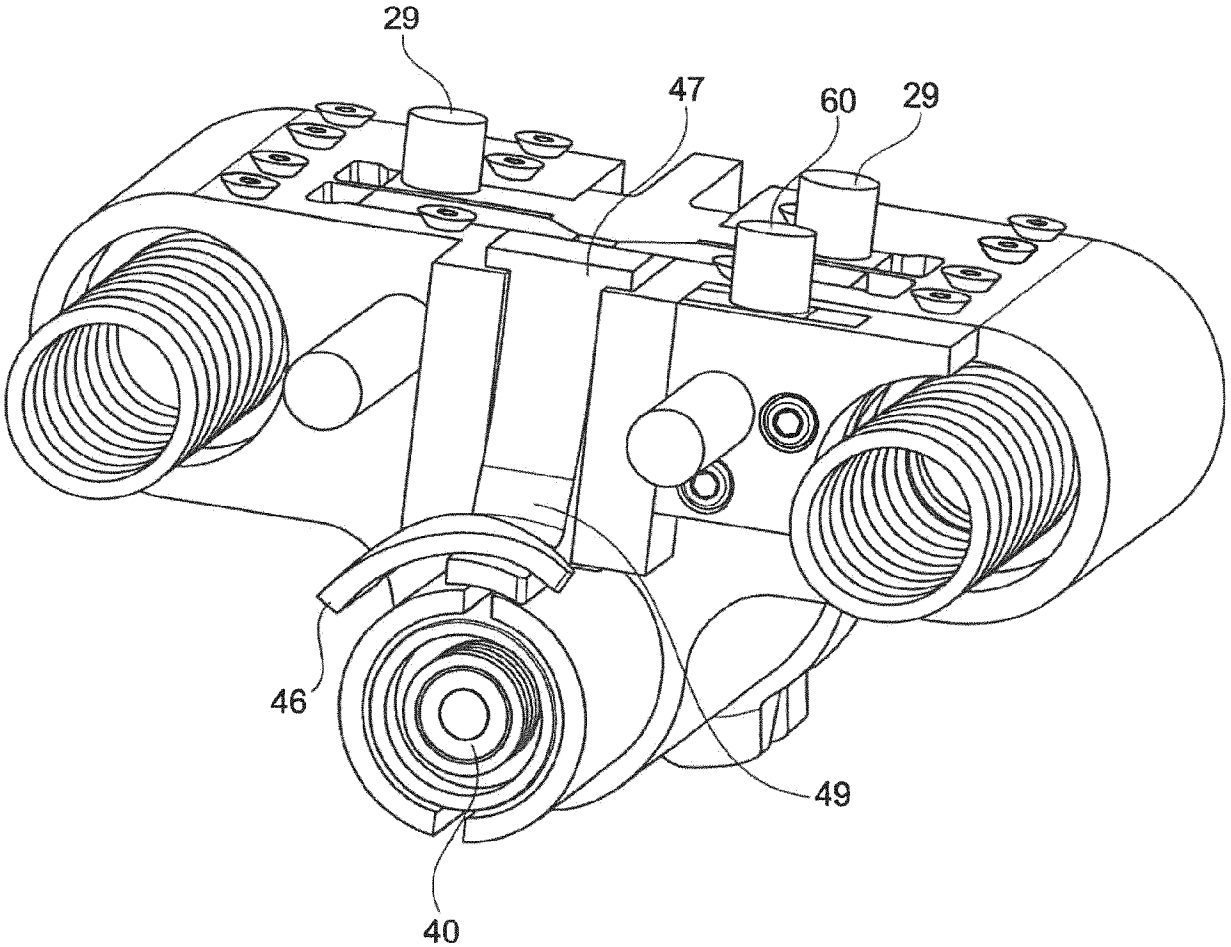
FIG. 9 shows a view of the breechblock carrier from FIG. 5, including a firing pin.
Figure 10:
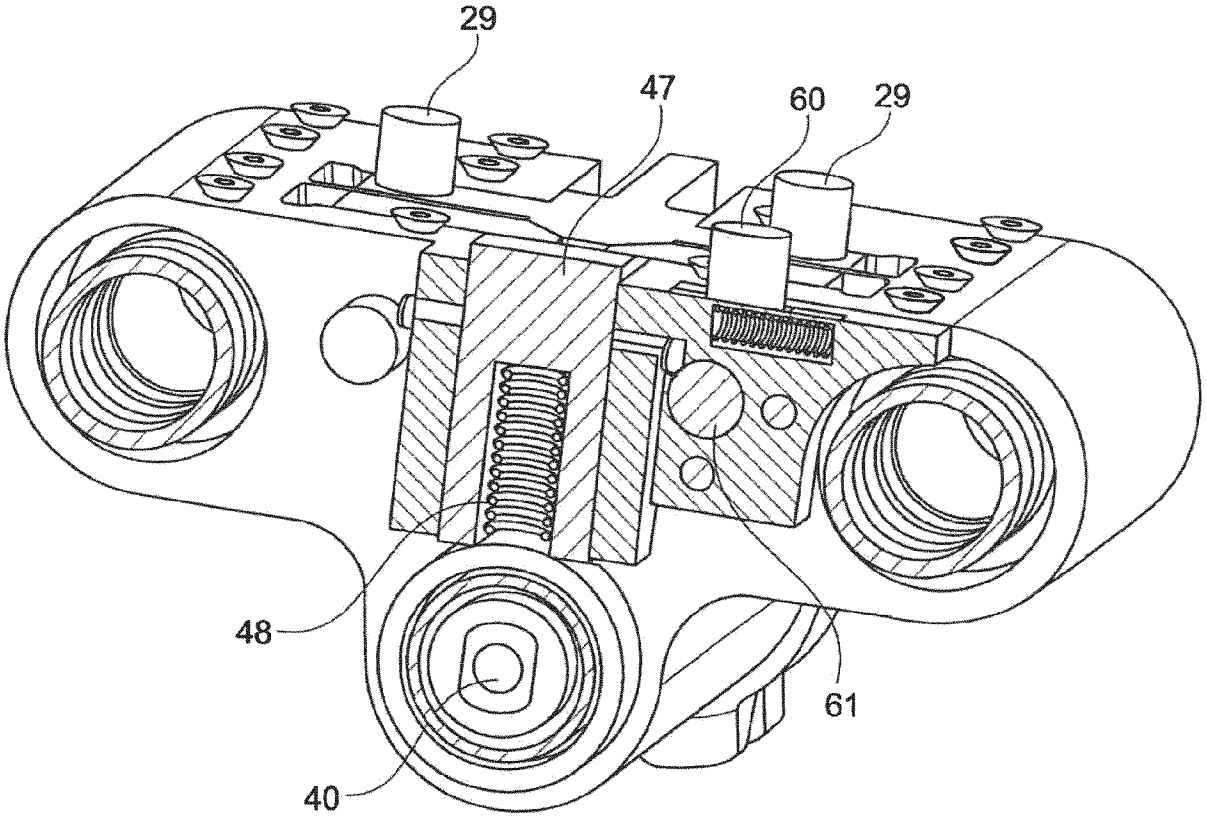
FIG. 10 shows another view from FIG. 9.

A fourth slide 47 is pressed upward by a spring 48 in the starting position (FIG. 9). During the forward motion of breechblock 3 or breechblock carrier 5 during the actual weapon function, breechblock head 3, together with its control bolt 22, slides along guide curve 21 and locks to gun barrel 2. During this rotational movement, tensioning bushing 46 is guided toward the rear along its tensioning curve 49 with firing pin 40 against fourth slide 47 against the firing direction, tensions pressure spring 41 situated therein and thus firing pin 40 (FIG. 10).

When breechblock head 3 has ended its rotational movement, fourth slide 47 runs on a cam 70 in carrier 4. Fourth slide 47 moves downward thereby, and tensioning bushing 46 loses its support. Tensioning bushing 46 and firing pin 40 are pressed forward by released pressure spring 41. Firing pin 40 leaves bore 44 of breechblock head 3 at the front side and fires a cartridge carried along. In this position, a fifth slide 60 locks fourth slide 47 in its lower position via a pin 61.

Slide 60 remains in this position up to the discharge operation. Upon the retraction of breechblock slider 6, cam 70 actuates this fifth slide 60, so that fourth slide 47 may be pressed into its starting position by spring 48.

The cycle begins again with the gun recoil which sets in.

The weapon or the weapon system may fire individual shots in a targeted manner as well as fire fully automatically.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A weapon system comprising:

a breechblock, the breechblock being mechanically connected to a breechblock slider of the weapon system;

a device that provides a mechanical separation between a breechblock carrier of the breechblock and the breechblock slider, in which the breechblock carrier is movable independent of the breechblock slider, during a recoil of recoiling masses of the weapon system, and that establishes a mechanical connection between the breechblock slider and the breechblock carrier, in which the breechblock carrier moves together with the breechblock slider, during a forward motion of the recoiling masses, wherein at least one connection rod of the device detachably connects the breechblock carrier to the breechblock slider to provide the mechanical connection, and wherein a rear end of the connection rod is fixedly mounted on the breechblock slider, viewed in a firing direction, and a front end of the connection rod is connected to or separated from the breechblock carrier.

2. The weapon system according to claim 1, wherein the breechblock is formed at least by the breechblock carrier and a breechblock head, and the breechblock carrier being designed so as to carry the breechblock head.

3. The weapon system according to claim 2, wherein the breechblock head is movable relative to the breechblock carrier.

4. The weapon system according to claim 2, further comprising a guide curve introduced into the breechblock carrier for guiding a control bolt of the breechblock head.

5. The weapon system according to claim 2, wherein a firing pin is integrated into a bore in the breechblock head.

6. The weapon system according to claim 2, wherein the at least one connection rod includes two connection rods, which are oriented in parallel to each other, the breechblock head being arranged between the two connection rods.

7. The weapon system according to claim 1, wherein the breechblock slider moves the breechblock carrier when the mechanical connection is established.

8. The weapon system according to claim 1, wherein the device includes at least one first slide, which protrudes from the breechblock carrier in a direction of a gun barrel.

9. The weapon system according to claim 8, wherein the device includes at least one second slide for mechanically separating the connection rod from the breechblock carrier.

10. The weapon system according to claim 9, wherein the device includes at least one third slide, which releases the breechblock carrier during a return transport of the breechblock carrier by the breechblock slider in order to assume a starting position of the breechblock carrier.

11. The weapon system according to claim 1, wherein at least one bore is introduced into the breechblock carrier, and a front end of the connection rod is guided within the bore.

12. A method for unlocking the breechblock from a gun barrel of the weapon system according to claim 1, the method comprising:

initiating a weapon recoil and recoil of the recoiling masses; and unlocking the breechblock from the gun barrel during a forward motion of the recoiling masses.

13. The method according to claim 12, wherein the mechanical separation takes place between a breechblock carrier of the breechblock and the breechblock slider during the recoil of the recoiling masses, and the mechanical connection is established between the breechblock carrier and the breechblock slider during the forward motion of the recoiling masses.

14. The method according to claim 12, wherein a portion of forward motion energy of the recoiling masses is used to remove a cartridge casing from the gun barrel.

* * * * *